US006850195B2

(12) United States Patent
Onaka et al.

(10) Patent No.: US 6,850,195 B2
(45) Date of Patent: Feb. 1, 2005

(54) ANTENNA STRUCTURE AND COMMUNICATION APPARATUS INCLUDING THE SAME

(75) Inventors: Kengo Onaka, Yokohama (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 9 days.

(21) Appl. No.: 10/637,634

(22) Filed: Aug. 11, 2003

(65) Prior Publication Data

US 2004/0085248 A1 May 6, 2004

(30) Foreign Application Priority Data

Sep. 30, 2002 (JP) ..... 2002-286380

(51) Int. Cl.[7] ..... H01Q 1/38
(52) U.S. Cl. ..... 343/700 MS; 343/702
(58) Field of Search ..... 343/700 MS, 702, 343/846, 873, 848; H01Q 1/38

(56) References Cited

U.S. PATENT DOCUMENTS

| | | | | |
|---|---|---|---|---|
| 5,764,190 A | | 6/1998 | Murch et al. | 343/702 |
| 6,222,489 B1 | * | 4/2001 | Tsuru et al. | 343/700 MS |
| 6,373,436 B1 | * | 4/2002 | Chen et al. | 343/702 |
| 6,476,767 B2 | * | 11/2002 | Aoyama et al. | 343/700 MS |

FOREIGN PATENT DOCUMENTS

| | | |
|---|---|---|
| EP | 1 113 524 A2 | 7/2001 |
| EP | 1 137 097 A1 | 9/2001 |
| JP | 10-32409 | 2/1998 |
| JP | 11-8508 | 1/1999 |
| JP | 2002-124811 | 4/2002 |
| WO | WO 01/08255 | 2/2001 |

* cited by examiner

*Primary Examiner*—Don Wong
*Assistant Examiner*—Jimmy Vu
(74) *Attorney, Agent, or Firm*—Keating & Bennett, LLP

(57) ABSTRACT

An antenna includes a radiation electrode, with one end thereof being connected to a conductive portion located on a front or back surface of a board. The radiation electrode extends outward from the conductive portion starting from the connected end, is bent around an edge of the board, and extends to a side opposite to the side of the starting point with a space therebetween. The other end of the radiation electrode is not connected to the conductive portion so as to function as an open end. Since the radiation electrode extends from one side to the other side of the board, the electric length of the radiation electrode can be increased. Accordingly, the size and thickness of the radiation electrode can be reduced while keeping a set resonance frequency. Also, since a space defined by the board and the radiation electrode can be increased, the gain is greatly improved and the bandwidth is significantly broadened.

19 Claims, 19 Drawing Sheets

ANTENNA STRUCTURE AND COMMUNICATION APPARATUS INCLUDING THE SAME

BACKGROUND OF THE INVENTION

1. Field of the Invention

The present invention relates to an antenna structure used for radio communication and a communication apparatus including the same.

2. Description of the Related Art

Various types of antenna structures to be provided in radio communication apparatuses have been proposed. For example, in the antenna structure disclosed in Japanese Unexamined Patent Application Publication No. 11-8508 (reference 1), a reinforcing portion 31 made of resin is integrally formed in an antenna portion 30 including a plate, as shown in FIG. 17B. The antenna portion 30 is attached to a printed wiring board 32, as shown in FIG. 17A.

Also, Japanese Unexamined Patent Application Publication No. 10-32409 (reference 2) discloses an antenna structure shown in FIG. 18. In this antenna structure, a plate antenna 35 is integrated into a casing 36. The casing 36 encases components mounted on a printed board 37 (the components are mounted on the back surface of the printed board 37, and thus are not shown in FIG. 18).

Further, the antenna structure disclosed in Japanese Unexamined Patent Application Publication No. 2002-124811 (reference 3) is shown in the cross-sectional view in FIG. 19. In this structure, an antenna 41 is located in a space 45 defined by one end of a circuit board 42, a front cover 43, and a back cover 44, along the internal surface of the back cover 44. Further, an antenna-grounding surface 46 is located along the internal surface of the front cover 43, which faces the antenna 41 with a space therebetween. The antenna 41 and the antenna-grounding surface 46 are connected to the circuit board 42 via conductors 48. Reference numeral 47 denotes a speaker, which is a component of a communication apparatus.

In portable communication apparatuses, the size and thickness are required to be reduced. In order to satisfy this requirement, the size and thickness of antennas used for the apparatuses should be reduced. Accordingly, in the antenna structures of the references 1 to 3, the profile of the antennas 30, 35, and 41 relative to the circuit boards 32, 37, and 42, respectively, should be lowered so as to reduce the thickness of the antennas. However, the profile of the antennas 30, 35, and 41 has an effect on a bandwidth of radio waves for communication of the antennas 30, 35, and 41. Therefore, by lowering the profile of the antennas 30, 35, and 41, the bandwidth of the antennas 30, 35, and 41 becomes narrow.

Further, if the area of each of the antennas 30, 35, and 41 is reduced in order to miniaturize the antenna structure, the antenna gain is disadvantageously deteriorated.

Also, if the size and thickness of the antennas 30, 35, and 41 are simply reduced, the resonance frequency of the antennas 30, 35, and 41 is changed from a set frequency. Therefore, when the size and thickness of the antenna structure are reduced, the resonance frequency of the antennas 30, 35, and 41 must be matched to the set frequency. In that case, however, if an object serving as a ground, such as a shield case, approaches the antenna 30, 35, or 41, the antenna characteristic is significantly deteriorated.

SUMMARY OF THE INVENTION

In order to solve the above-described problems, preferred embodiments of the present invention provide an antenna structure in which the size and thickness can be easily reduced while significantly improving antenna gain and broadening a bandwidth, and also provide a communication apparatus including such a novel antenna structure.

According to a preferred embodiment of the present invention, an antenna structure includes a board on which electronic components are mounted, a conductive portion disposed on at least one of a front surface and a back surface of the board, and a radiation electrode for performing an antenna operation. One end of the radiation electrode is connected to the conductive portion, the radiation electrode extends outward from the conductive portion starting from the connected end, is bent around an edge of the board so as to have a loop-like configuration, and extends to a side opposite to the side of the starting point such that a space is formed between the radiation electrode and the board. The other end of the radiation electrode is positioned such that a space is formed between the other end and the conductive portion of the board with a capacitance therebetween, so that the other end functions as an open end.

In another preferred embodiment of the present invention, a communication apparatus includes the antenna structure of the above-described preferred embodiment of the present invention.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Hereinafter, preferred embodiments of the present invention will be described with reference to the drawings.

Figure 1A:
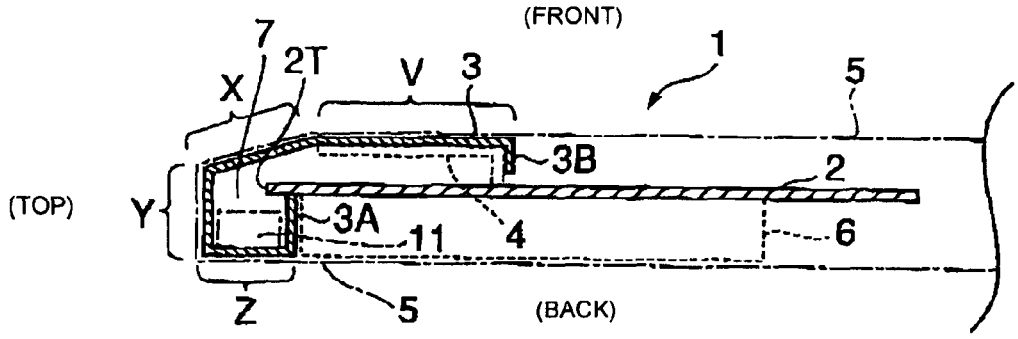
FIGS. 1A to 1C show an antenna structure of a first preferred embodiment of the present invention.
Figure 1B:
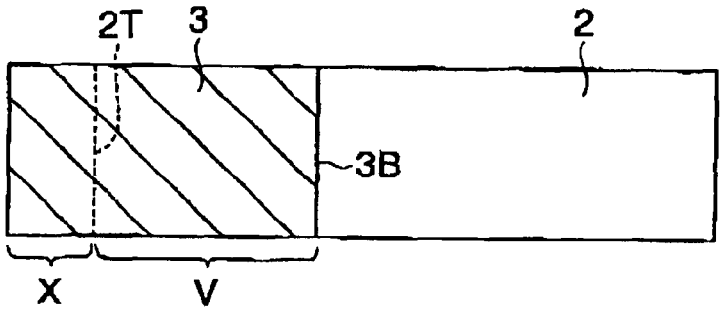
Figure 1C:
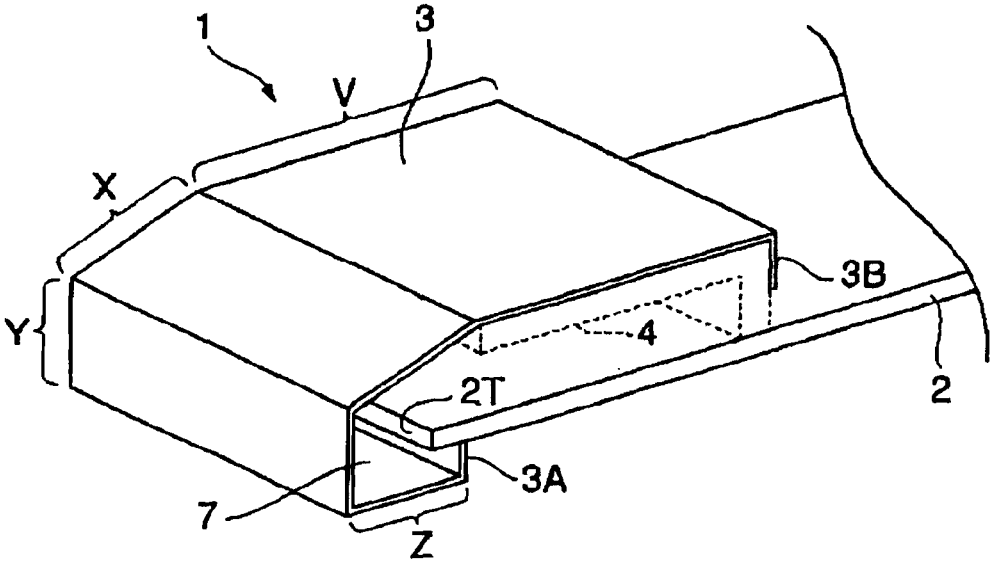

FIG. 1A is a side view showing the structure of an antenna 1 according to a first preferred embodiment. FIG. 1B is a plan view of the antenna 1 shown in FIG. 1A, viewed from the front surface thereof. FIG. 1C is a schematic perspective view of the antenna 1 according to the first preferred embodiment of the present invention.

The antenna 1 of the first preferred embodiment is preferably incorporated into a portable phone, which is a communication apparatus, and includes a board 2 and a radiation electrode 3.

In the first preferred embodiment, the board 2 functions as a circuit board of the communication apparatus, and is accommodated in a casing 5 of the communication apparatus, the casing 5 being indicated with a chain line in FIG. 1A. A liquid crystal display 6, which is indicated with a broken line in FIG. 1A, is attached on the back surface of the board 2. Also, a ground electrode defining a conductive portion (not shown) is provided on the back surface of the board 2.

The radiation electrode 3 is used for transmitting/receiving radio waves, and is preferably formed by bending a conductive plate. The radiation electrode 3 is preferably a $\lambda/4$-type radiation electrode. One end 3A of the radiation electrode 3 is connected to the back surface of the board 2 (hereinafter the end 3A is referred to as connected end 3A), and the connected end 3A functions as a grounded end. The radiation electrode 3 extends outward from the board 2 starting from the connected end 3A, is bent around an edge 2T of the board 2 so as to form a loop-shaped configuration, and extends to the front side of the board 2. A portion V of the radiation electrode 3 is positioned above the front surface of the board 2 with a space therebetween, and the other end 3B is also positioned above the front surface of the board 2, so that the other end 3B functions as an open end.

In the first preferred embodiment of the present invention, the board 2 is accommodated in the casing 5 so that a space 7 is formed between the edge 2T in the top portion and the internal surface of the casing 5. The radiation electrode 3, which extends from the back surface to the front surface of the board 2, extends along the internal surface of the casing 5, which faces the space 7. That is, the length of the radiation electrode 3 (distance from the connected end 3A to the open end 3B) is maximized in the limited space inside the casing 5.

A radio frequency circuit (RF circuit) used for communication of the communication apparatus is connected to the radiation electrode 3. In order to connect the radiation electrode 3 to the RF circuit, a direct connecting method or a capacitive connecting method may be used. In the direct connecting method, a signal conduction unit which is connected to the RF circuit in conduction is directly connected to the radiation electrode 3. In the capacitive connecting method, the signal conduction unit which is connected to the RF circuit in conduction is connected to the radiation electrode 3 via capacitance. Herein, any of the direct connecting method and the capacitive connecting method may be used in order to connect the radiation electrode 3 and the RF circuit.

Figure 2A:
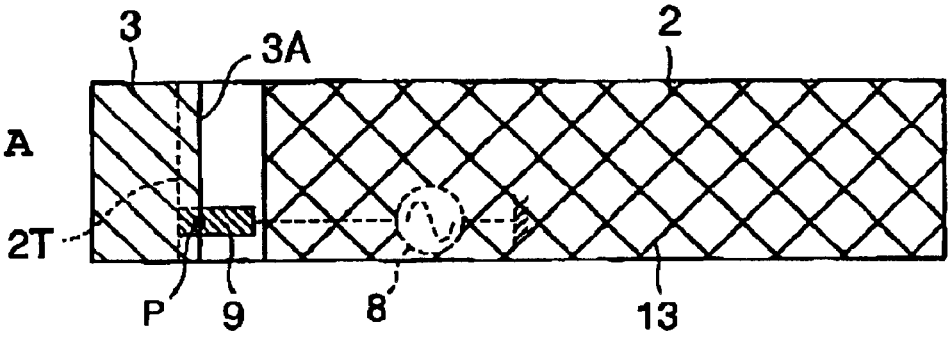
FIGS. 2A to 2E illustrate examples of a configuration in which a radiation electrode is directly connected to a signal conduction unit.

For example, when the direct connecting method is adopted, a signal conduction unit 9, which defines a conductive pattern (feeding electrode) and which is connected to an RF circuit 8 of the communication apparatus in conduction, is formed in an area where the radiation electrode 3 is connected to the back surface of the board 2, as shown in FIG. 2A. Since the connected end 3A of the radiation electrode 3 is connected to the back surface of the board 2, the connected end 3A is directly connected to the signal conduction unit 9, which defines a conductive pattern (feeding electrode), so that the radiation electrode 3 is connected to the RF circuit 8 in conduction. Reference numeral 13 in FIG. 2A denotes a ground electrode, which is a conductive portion located on the back surface of the board 2. Also, the feeding electrode 9 formed by the conductive pattern can be regarded as a branch electrode of the radiation electrode 3.

Figure 2B:
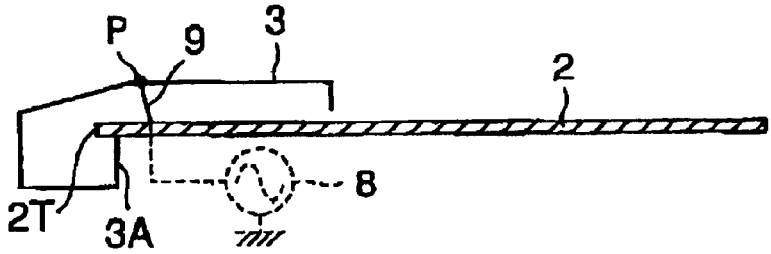
Figure 2C:
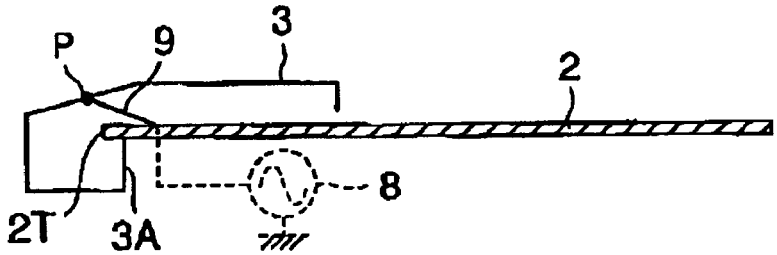
Figure 2D:
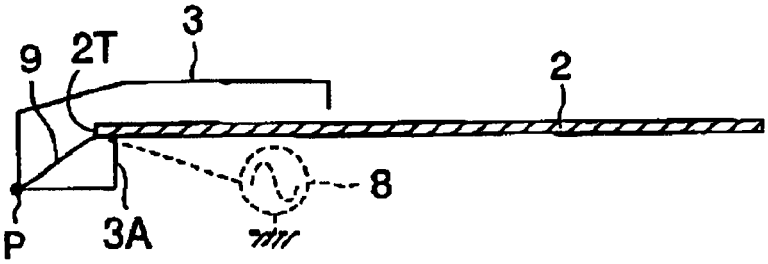
Figure 2E:
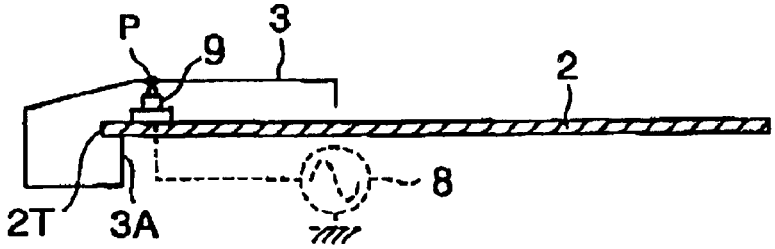

When the direct connecting method is adopted, the structures shown in FIGS. 2B to 2E may be used instead of the structure shown in FIG. 2A. As shown in FIGS. 2B to 2D, the conductive pattern may be formed as a part of the radiation electrode 3, or the radiation electrode 3 may be directly connected to the RF circuit 8 by using the signal conduction unit 9 formed by a coaxial line. Also, as shown in FIG. 2E, the radiation electrode 3 may be connected to the RF circuit 8 via the signal conduction unit 9 formed by a spring pin or other suitable member, the spring pin being fixed to the board 2.

When the direct connecting method is adopted, the position of a connecting point P between the signal conduction unit 9 and the radiation electrode 3 is not limited, as shown in FIGS. 2A to 2E. That is, the signal conduction unit 9 may be connected to a suitable position of the radiation electrode 3, considering various conditions such as a circuit structure provided on the board 2. For example, the signal conduction unit 9 is directly connected to a portion of the radiation electrode 3 so that the impedance of that portion is substantially equal to the impedance between the connecting portion P of the radiation electrode 3 and the signal conduction unit 9 and the RF circuit 8. In this case, the impedance in the radiation electrode 3 side can be matched to that in the RF circuit 8 side and a matching circuit need not be provided, and thus the circuit structure can be simplified.

On the other hand, when the capacitive connecting method is adopted, as shown in FIGS. 3A to 3E, the signal conduction unit 9 conducted to the RF circuit 8 is arranged such that a space is formed between the signal conduction unit 9 and the open end 3B of the radiation electrode 3.

Figure 3A:
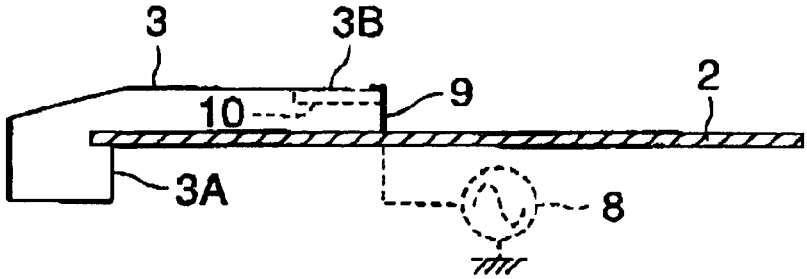
FIGS. 3A to 3E illustrate examples of a configuration in which the radiation electrode is connected to the signal conduction unit via capacitance.
Figure 3B:
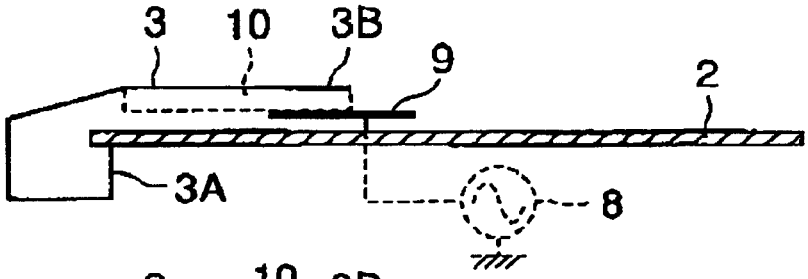
Figure 3C:
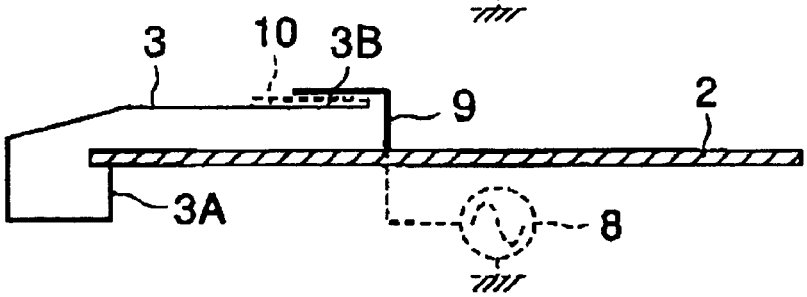
Figure 3D:
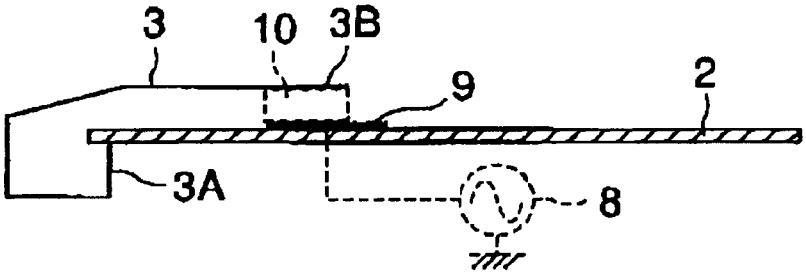
Figure 3E:
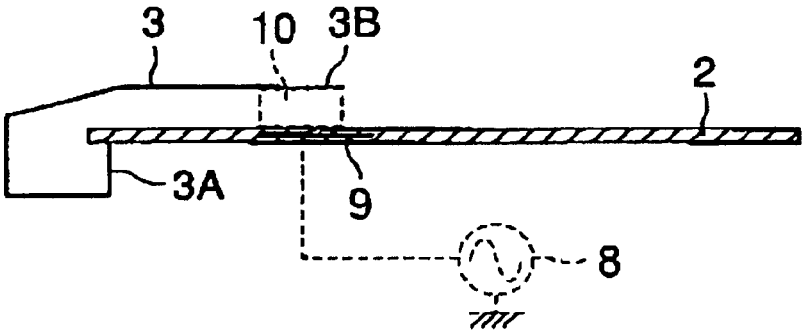

Accordingly, the open end 3B of the radiation electrode 3 is connected to the signal conduction unit 9 via capacitance. There are conditions for realizing favorable capacitive coupling of the signal conduction unit 9 and the open end 3B of the radiation electrode 3. The space between the signal conduction unit 9 and the open end 3B of the radiation electrode 3 and the facing area of the signal conduction unit 9 and the open end 3B of the radiation electrode 3 are adequately set so as to satisfy the conditions. Further, the position and shape of the signal conduction unit 9 are determined based on the setting, by considering the position of components on the board 2 and wiring of a circuit pattern. In FIG. 3D, a feeding electrode formed by a conductive pattern is formed on the front surface of the board 2, the feeding electrode functioning as the signal conduction unit 9. Also, in FIG. 3E, a feeding electrode serving as the signal conduction unit 9 is disposed inside the board 2.

When the radiation electrode 3 is coupled with the signal conduction unit 9 by capacitive coupling, a dielectric 10, indicated with a broken line in FIGS. 3A to 3E, may be provided between the signal conduction unit 9 and the open end 3B of the radiation electrode 3. By changing the permittivity of the dielectric 10, the capacitance between the signal conduction unit 9 and the open end 3B of the radiation electrode 3 can be changed. Accordingly, by using the dielectric 10, the signal conduction unit 9 and so on can be easily designed so that a favorable capacitive coupling between the signal conduction unit 9 and the open end 3B of the radiation electrode 3 can be realized.

When the radiation electrode 3 is miniaturized in accordance with miniaturization of the communication apparatus (portable phone), the electric length of the radiation electrode 3, which has an effect on the resonance frequency of the radiation electrode 3, is shortened or the capacitance between the radiation electrode 3 and the ground becomes small, and thus it becomes difficult to match the resonance frequency of the radiation electrode 3 to a set frequency. In this case, a dielectric 4 is provided between at least the open end 3B of the radiation electrode 3 and the front surface of the board 2, as indicated with a broken line in FIGS. 1A and 1C. By providing the dielectric 4 between the front surface of the board 2 and the radiation electrode 3, the electric length of the radiation electrode 3 is increased due to the permittivity of the dielectric 4, and also the capacitance between the radiation electrode 3 (in particular, open end 3B) and the ground is increased. Thus, the resonance frequency of the radiation electrode 3 can be easily matched to the set frequency. In other words, by providing the dielectric 4, the radiation electrode 3 can be easily miniaturized while allowing the radiation electrode 3 to have the set resonance frequency.

The antenna 1 of the first preferred embodiment is preferably formed in the above-described manner. In the communication apparatus including the antenna 1, a component (for example, a speaker 11) may be disposed in a space defined by the radiation electrode 3, in order to use the space effectively.

As described above, in the first preferred embodiment, the radiation electrode 3 extends from the back surface to the front surface of the board 2 by bending around the edge 2T of the board 2, so as to form a loop-like configuration. With this loop-like arrangement of the radiation electrode 3, the gain of the antenna can be increased and the bandwidth can be broadened. This has been verified by an experiment conducted by the inventors.

Figure 5A:
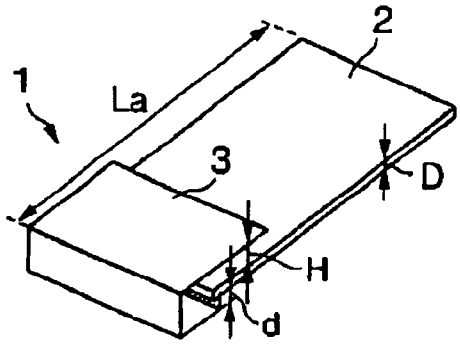
FIGS. 5A to 5D show samples used in the experiment shown in FIGS. 4A and 4B.
Figure 5C:
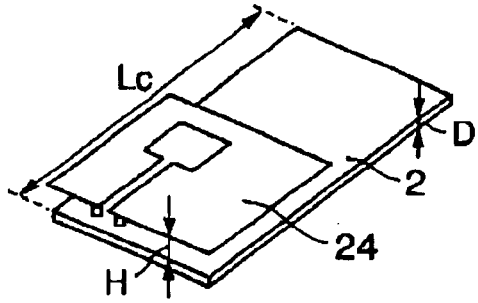
Figure 5B:
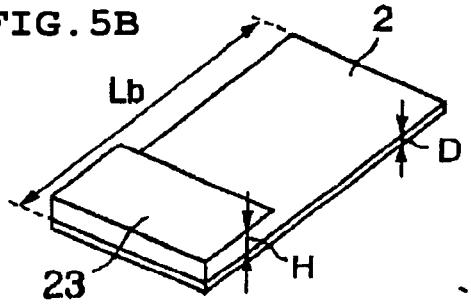
Figure 5D:
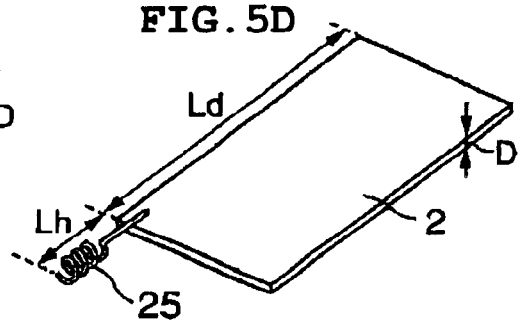

In the experiment, the following various samples were prepared: the λ/4-type antenna 1 having a configuration according to the first preferred embodiment of the present invention, as shown in FIG. 5A; a λ/4-type antenna provided with a radiation electrode 23 which is not extended to the back surface of the board 2, as shown in FIG. 5B; an inverted F antenna as shown in FIG. 5C; and a helical antenna 25 as shown in FIG. 5D. For the antenna 1, three types of antennas were prepared: two samples, in which the distance between the back surface of the board 2 and the radiation electrode 3 in the back surface of the board 2 is about 2.5 mm and about 5 mm, respectively, and a multi-resonance type sample (distance d is 5 mm) according to a second preferred embodiment, which will be described later. In these samples, each of the lengths La, Lb, Lc, and Ld is about 80 mm, and the thickness D of the board 2 is about 1 mm. In the λ/4-type radiation electrodes 3 and 23 and the inverted F antenna 24, the height H from the board 2 is about 4 mm. The inverted F antenna 24 has a size of about 40 mm×about 30 mm. In the helical antenna 25, the length Lh of a portion protruded from the board 2 is about 30 mm. The helical antenna 25 is formed by winding a copper wire of ϕ 0.8 mm so that the outside diameter is about 7.6 mm.

These samples were evaluated in terms of pattern averaging gain (PAG). As shown in FIG. 4B, the antenna 1, which is positioned such that the front side of the board 2 is positioned outside, was rotated about a rotation axis O vertical to the ground, so as to measure a gain for a horizontally polarized wave and a vertically polarized wave at each of predetermined angles. Then, the measurement result was averaged. In this case, the PAG was calculated by subtracting 9 dB from the average gain for the horizontally polarized wave and adding the result to the vertically polarized wave.

Figure 4A:
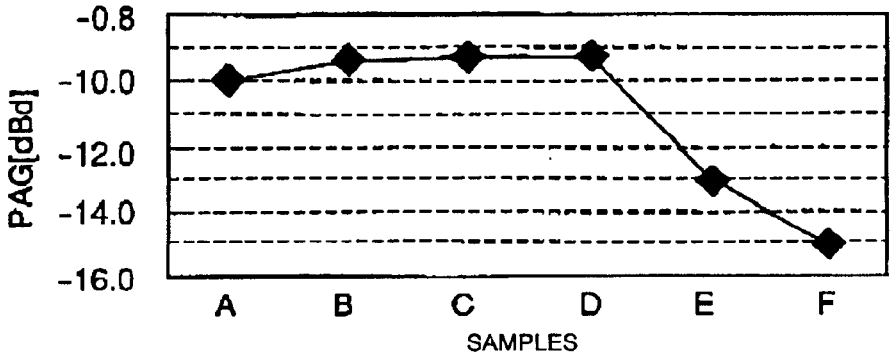
FIG. 4A shows an experiment result showing an effect of increased gain obtained by the antenna structure of the first preferred embodiment.
Figure 4B:
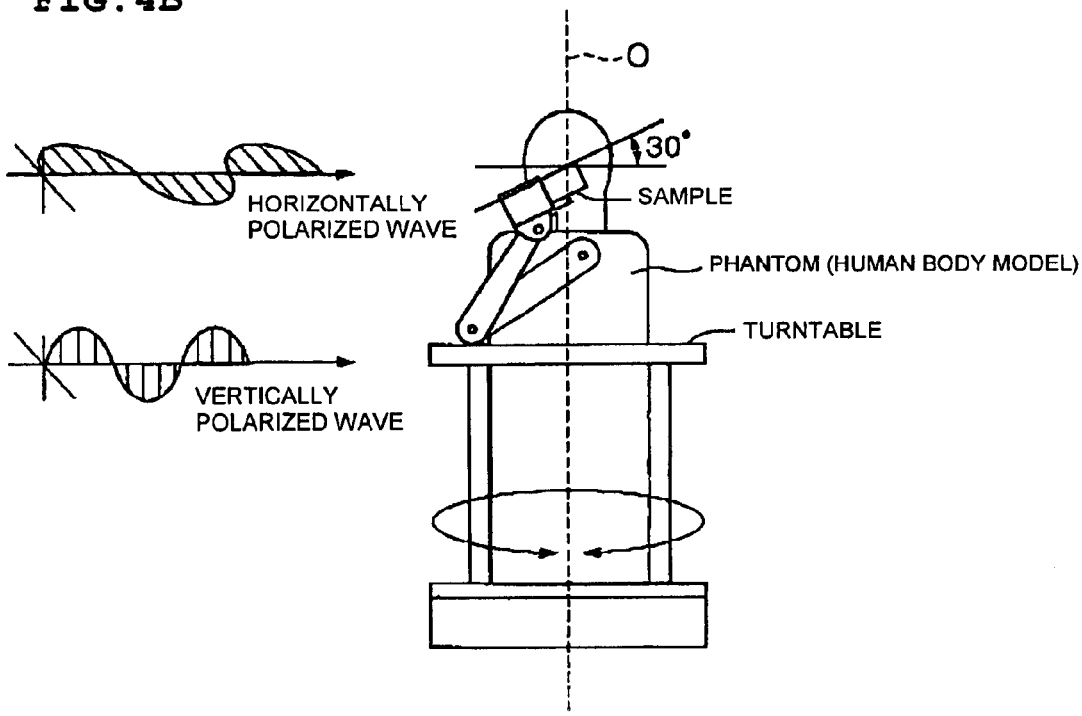
FIG. 4B illustrates the experiment.

The result is shown in FIG. 4A. In FIG. 4A, a sample A is the antenna 1 in which distance d dose not exist, that is, the radiation electrode is not extended to the back surface of the board (see FIG. 5B); a sample B is the antenna in which the distance d is about 2.5 mm (see FIG. 5A); a sample C is the antenna in which the distance d is about 5 mm; a sample D is the multi-resonance type antenna in which the distance d is about 5 mm; a sample E is the inverted F antenna 24 (see FIG. 5C); and a sample F is the helical antenna 25 (see FIG. 5D).

As can be seen in FIG. 4A, the gain of the λ/4-type antennas (samples A to D) is much higher than that of the inverted F antenna 24 (sample E) and the helical antenna 25 (sample F). Further, among the λ/4-type antennas, the gain of the antennas having the distance d (samples B, C, and D) is higher than that of the antenna without the distance d (sample A). As shown in the result of the experiment, by forming the antenna in the manner described in the first preferred embodiment, the gain of the antenna can be effectively improved.

Figure 6:
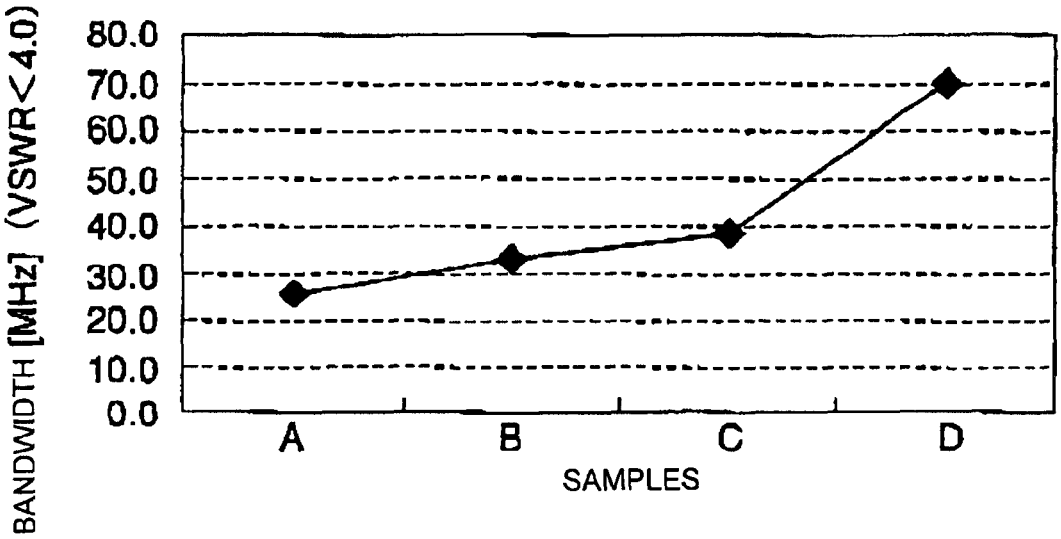
FIG. 6 is a graph of an experiment result showing an effect of broadening a bandwidth obtained by the antenna structure of the first preferred embodiment of the present invention.

Also, the inventors have studied an example of the relationship between the distance d and the bandwidth in the λ/4-type antennas (samples A to D). The result is shown in FIG. 6. As shown in the result, in the λ/4-type antennas, the bandwidth of the antenna can be broadened as the distance d is increased. The reason for this is as follows.

Figure 8:
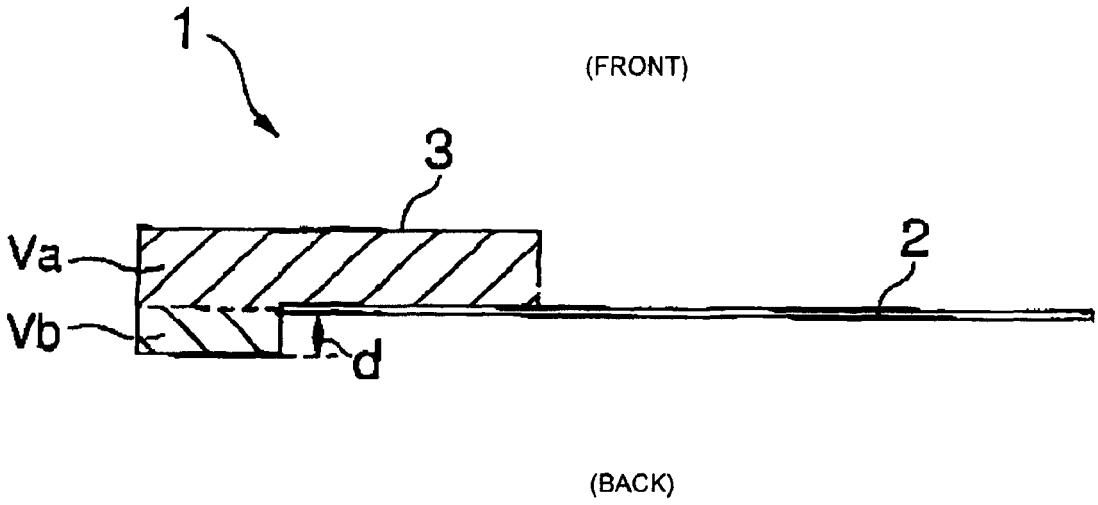
FIG. 8 is used for explaining the reason for obtaining a broadband effect in the antenna structure of the first preferred embodiment of the present invention.

A bandwidth depends on the volume defined by the radiation electrode and the board (hereinafter referred to as electric volume), and the bandwidth increases as the electric volume increases. By generating the distance d, an electric volume Vb is generated in the back surface of the board 2, in addition to an electric volume Va in the front surface of the board 2, as shown in FIG. 8. Therefore, total electric volume increases by the electric volume Vb, and thus the bandwidth is broadened.

Figure 7A:
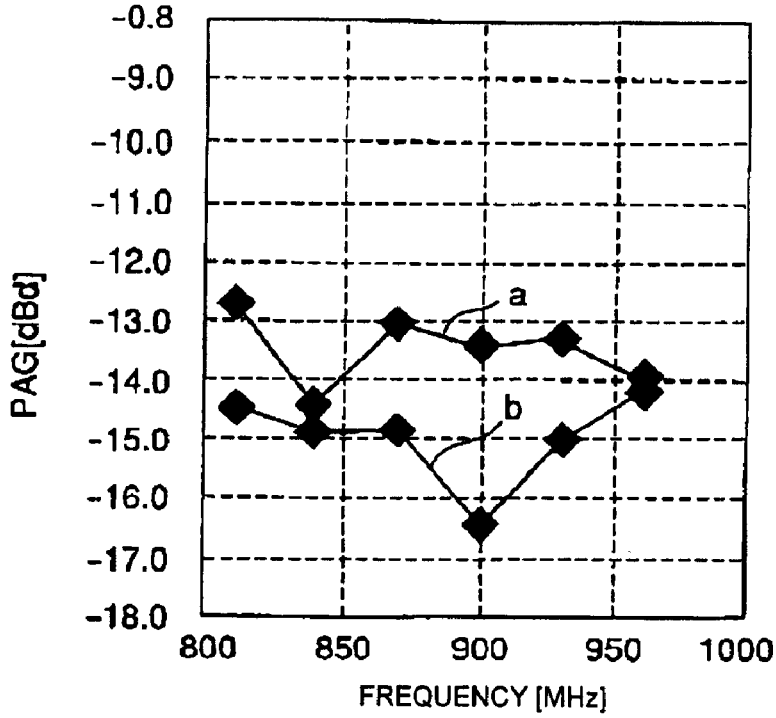
FIG. 7A is a graph for comparing the gain of the antenna of the first preferred embodiment and the gain of a $\lambda/2$-type whip antenna.
Figure 7B:
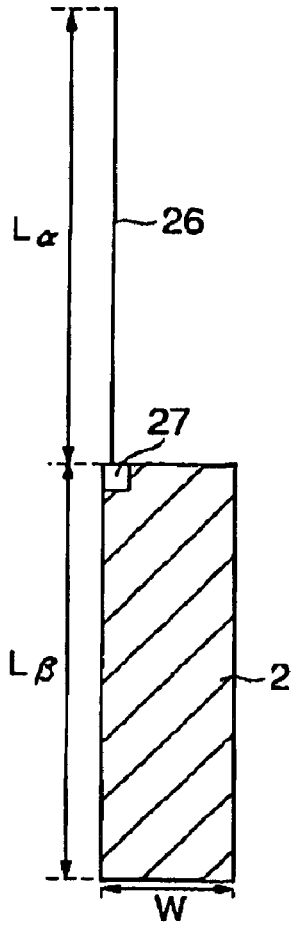
FIG. 7B shows the $\lambda/2$-type whip antenna.

Further, the inventors have conducted an experiment for finding the PAG of the antenna 1 of the first preferred embodiment and a λ/2-type whip antenna. The result is shown in FIG. 7A. In FIG. 7A, a solid line a corresponds to the antenna 1 of the first preferred embodiment and a solid line b corresponds to the λ/2-type whip antenna. As shown in FIG. 7A, the gain of the antenna 1 of the first preferred embodiment is higher than that of the λ/2-type whip antenna. The λ/2-type whip antenna used in this experiment has a configuration shown in FIG. 7B, in which the board 2 has a length $L_\beta$ of about 110 mm, a width W of about 35 mm, and a thickness of about 1 mm. Also, the antenna length $L_\alpha$ of the whip antenna 26 is about 100 mm and the diameter ϕ is about 1.25 mm. Reference numeral 27 in FIG. 7B denotes a matching circuit.

As described above, in the antenna 1 of the first preferred embodiment, higher gain and broader bandwidth can be realized compared to other types of antennas, such as a λ/2-type antenna and an inverted F antenna. Furthermore, as described above, the electric length of the radiation electrode 3 can be increased without taking any special measures, for example, without changing the shape of the radiation electrode 3. Therefore, the size and thickness of the radiation electrode 3 can be reduced while keeping the resonance frequency at the set frequency.

Figure 9:
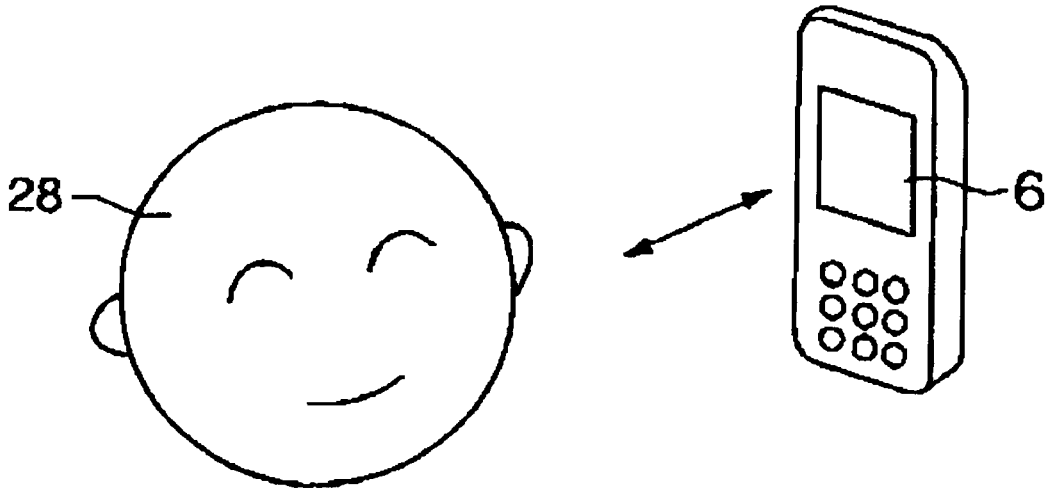
FIG. 9 is a model diagram used for explaining a state where the antenna characteristic of a portable phone is deteriorated.

Furthermore, in the antenna 1 of the first preferred embodiment, deterioration of the antenna characteristic, which may be caused when a human's head approaches the antenna, can be easily suppressed. For example, while the portable phone is being used, a human's head 28 regarded as a ground may move with respect to the portable phone in a perspective direction, as shown in FIG. 9. As in the helical antenna 25 shown in FIG. 10B and the inverted F antenna 24 shown in FIG. 10C, when electric fields $E_f$ and $E_b$ are generated by using the board 2 as well as the antenna, the distribution of the electric field $E_b$ in the back portion (the portion provided with the liquid crystal display 6) of the board 2 is the same as the distribution of the electric field $E_f$ in the front portion of the board 2. In this state, when the human's head 28 approaches the antenna, that has an effect on the electric field $E_b$ in the back portion of the board 2, and thus the antenna characteristic is deteriorated.

Figure 10A:
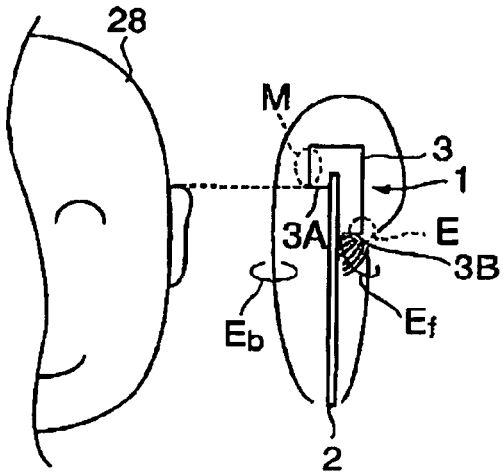
FIGS. 10A to 10D are used for explaining the reason for suppressing deterioration of the antenna characteristic while a communication apparatus is being used, the suppression being one of the effects obtained in the antenna structure of the first preferred embodiment of the present invention.
Figure 10B:
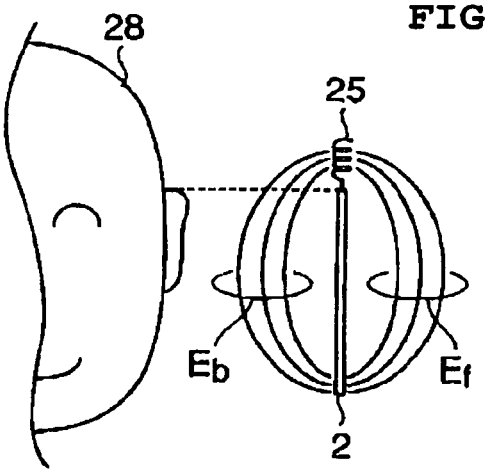
Figure 10C:
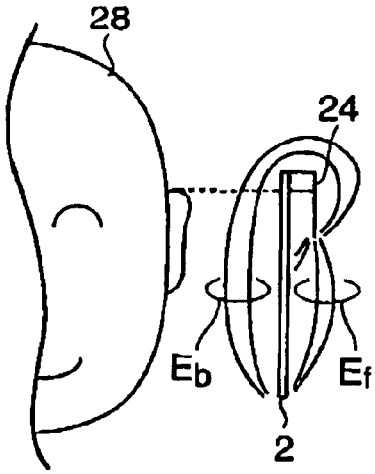
Figure 10D:
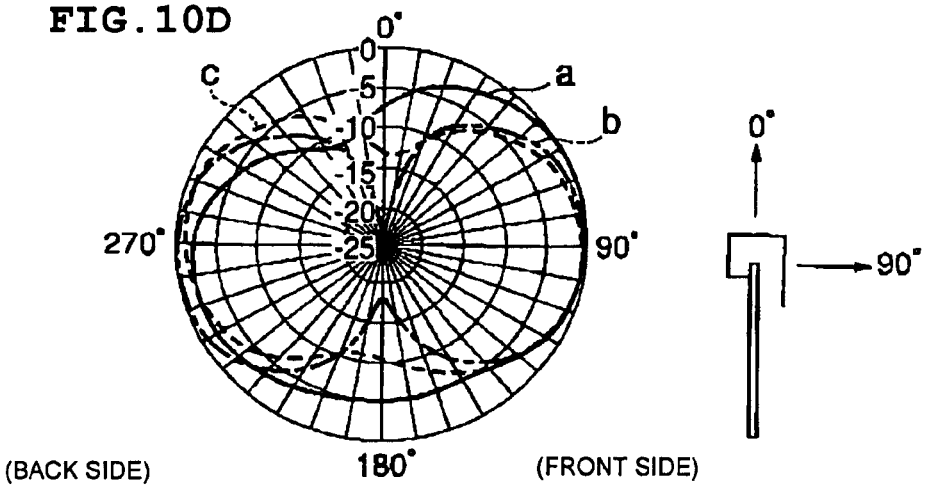

On the other hand, in the antenna 1 of the first preferred embodiment, as shown in FIG. 10A, the vicinity of the open end 3B of the radiation electrode 3 defines a maximum electric field region E, and the vicinity of the connected end 3A of the radiation electrode 3 defines a maximum magnetic field region M. In this configuration, the dependence of radiation from the board 2 is suppressed with respect to the inverted F antenna 24 and the helical antenna 25, and radio waves are radiated from the radiation electrode 3 at a high rate. In the antenna 1, the electric filed distribution in the back portion of the board 2 can be significantly suppressed compared to the front portion thereof. This can be seen in a graph in FIG. 10D, the graph showing the directivity obtained by the experiment. In FIG. 10D, a solid line a corresponds to the antenna 1 according to the first preferred embodiment, a long-and-short dashed line b corresponds to the helical antenna 25, and a broken line c corresponds to the inverted F antenna 24. Also, an F/B ratio, which is the ratio of gain in the back portion to gain in the front portion, was calculated. The F/B ratio of the inverted F antenna 24 is about 0.5 dB and the F/B ratio of the helical antenna 25 is about 0 dB. On the other hand, the F/B ratio of the antenna 1 of the first preferred embodiment is about 2.5 dB. As can be understood from the result, the electric field distribution in the back portion of the board 2 can be suppressed so as to be much smaller than the front portion thereof in the antenna 1. In this way, the above-described tendency can be seen in a directional gain of a distant field.

In the antenna 1 of the first preferred embodiment, the effect of the electric field $E_b$ in the back portion of the board 2 on the antenna characteristic is much smaller than the effect of the electric field $E_f$ in the front portion of the board 2 on the antenna characteristic, due to the above-described electric field distribution. Therefore, even if the human's head 28 approaches the back portion of the board 2 and the electric field $E_b$ in the back portion of the board 2 is affected, a negative effect on the antenna characteristic due to the approach of the human's head 28 can be prevented, and thus deterioration of the antenna characteristic is reliably prevented.

Next, a second preferred embodiment will be described. In the second preferred embodiment, elements which are the same as those in the first preferred embodiment are denoted by the same reference numerals, and the corresponding description will be omitted.

In the second preferred embodiment, the radiation electrode 3 includes a plurality of radiation electrode branches, as shown in FIGS. 11A to 11C and FIGS. 12A and 12B. The configuration of the antenna is almost the same as in the first preferred embodiment, except the radiation electrode 3.

These radiation electrode branches 3 are preferably loop-shaped, and are bent around the edge 2T of the board 2, as in the first preferred embodiment. The radiation electrode branches 3 have a common connected end 3B, and the other portions of the radiation electrode branches 3 are arranged with a space therebetween. In other words, the radiation electrode branches 3 are formed by branching a radiation electrode at a base portion thereof, the base portion being the connected end 3B.

Figure 11A:
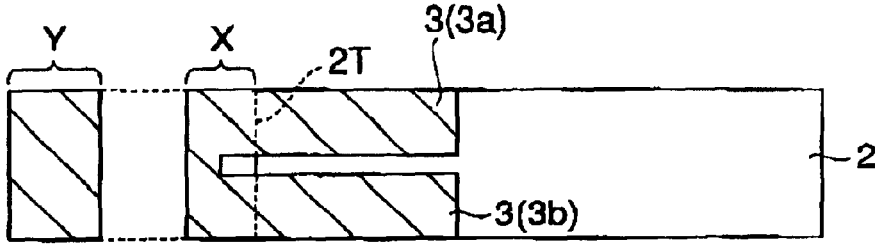
FIGS. 11A to 11C are developed views showing examples of a radiation electrode of a second preferred embodiment of the present invention.
Figure 11B:
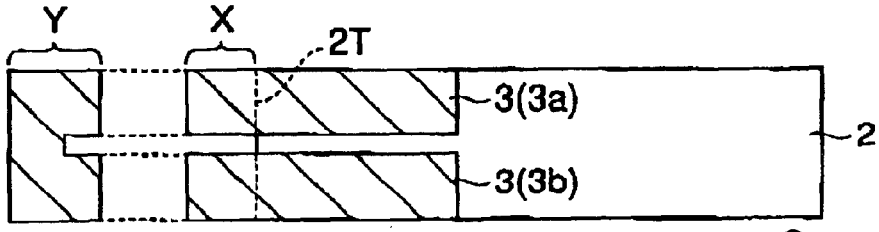
Figure 11C:
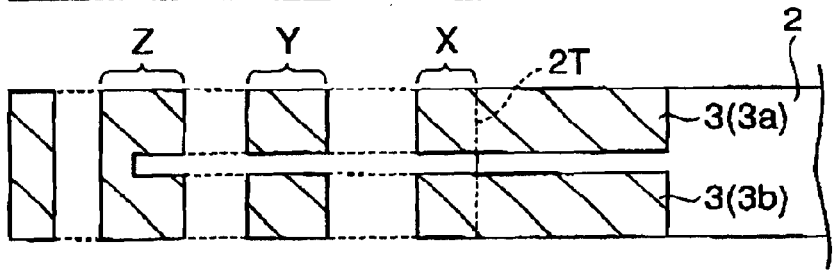

A junction point (branch point) of the radiation electrode branches 3 may be positioned at a portion X in the front portion of the board 2, as shown in FIG. 11A. Alternatively, the junction point may be positioned at a portion Y which faces the edge 2T with a space therebetween, as shown in FIG. 11B, or may be positioned at a portion Z in the back portion of the board 2, as shown in FIG. 11C. In this way, the junction point (branch point) of the radiation electrode branches 3 may be adequately set by considering, for example, the set resonance frequency of the radiation electrode branches 3.

Figure 12A:
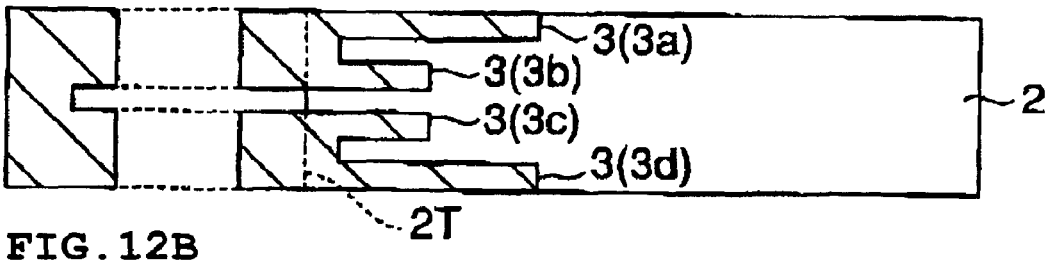
FIGS. 12A and 12B are developed views showing examples of the radiation electrode of the second preferred embodiment of the present invention.
Figure 12B:
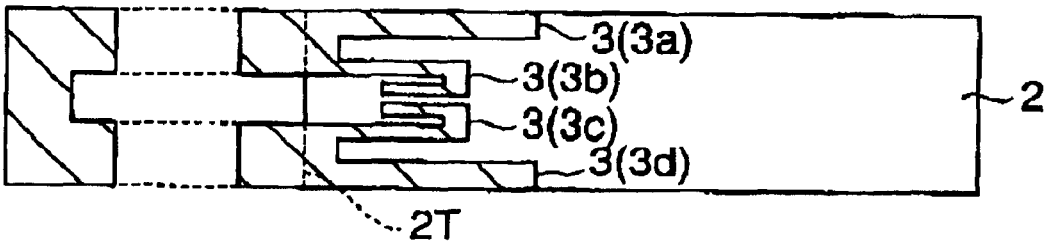

Also, the number of radiation electrode branches 3 is not limited to two. As shown in FIGS. 12A and 12B, three or more radiation electrode branches 3 may be provided.

Further, all of the radiation electrode branches 3 may be connected to the signal conduction unit 9 directly or indirectly via capacitance. Alternatively, at least one of the radiation electrode branches 3 may be connected to the signal conduction unit 9 directly or indirectly via capacitance, so that the radiation electrode branch functions as a feeding radiation electrode. In that case, the other radiation electrode branch(es) 3 is not connected to the signal conduction unit 9, but functions as a passive radiation electrode, which is coupled with the feeding radiation electrode by electromagnetic coupling so as to generate a multi-resonance state.

Figure 13A:
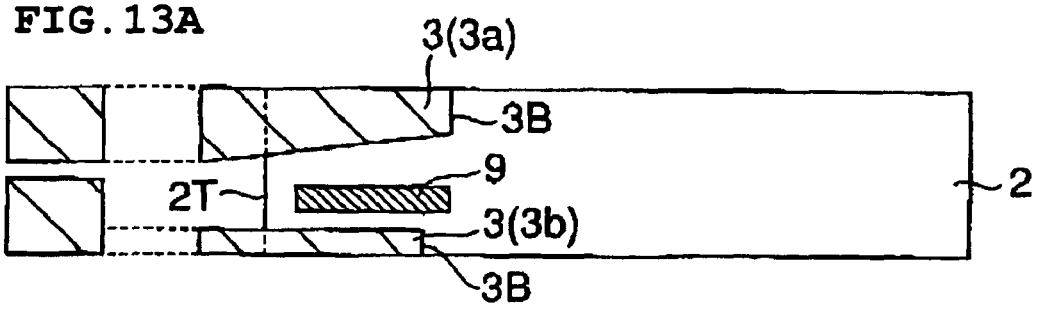
FIGS. 13A and 13B show examples of a signal conduction unit, which is connected to the radiation electrode of the second preferred embodiment of the present invention via capacitance.

For example, FIG. 13A shows an example of a configuration in which radiation electrode branches 3*a* and 3*b* are connected to a signal conduction unit 9 via capacitance. In this example, one signal conduction unit 9 is provided for the plurality of radiation electrode branches 3. Alternatively, a signal conduction unit 9 may be provided for each of the radiation electrode branches 3, in a one-to-one relationship.

Figure 13B:
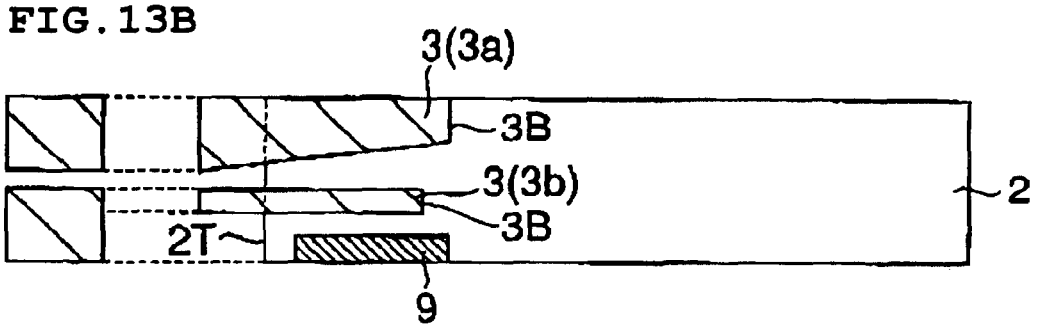

FIG. 13B shows an example in which both of a feeding radiation electrode and a passive radiation electrode are provided. In FIG. 13B, the radiation electrode branch 3*b* is connected to the signal conduction unit 9 via capacitance so as to function as a feeding radiation electrode, and the radiation electrode branch 3*a* is a passive radiation electrode which is not connected to the signal conduction unit 9. In this way, by generating a multi-resonance state by forming the feeding radiation electrode and the passive radiation electrode, the antenna gain can be further increased and the bandwidth can be broadened, as shown in the experiment result shown in FIGS. 4A and 6 (see sample D).

Further, as shown in FIGS. 12A and 12B, the effective length of the radiation electrode branches 3*a* and 3*d* may be different from that of the radiation electrode branches 3*b* and 3*c*, so that the radiation electrode branches 3*a* to 3*d* have different resonance frequency bands. In this way, by forming the plurality of radiation electrode branches 3, the antenna 1 can perform radio communication in a plurality of frequency bands.

Figure 14:
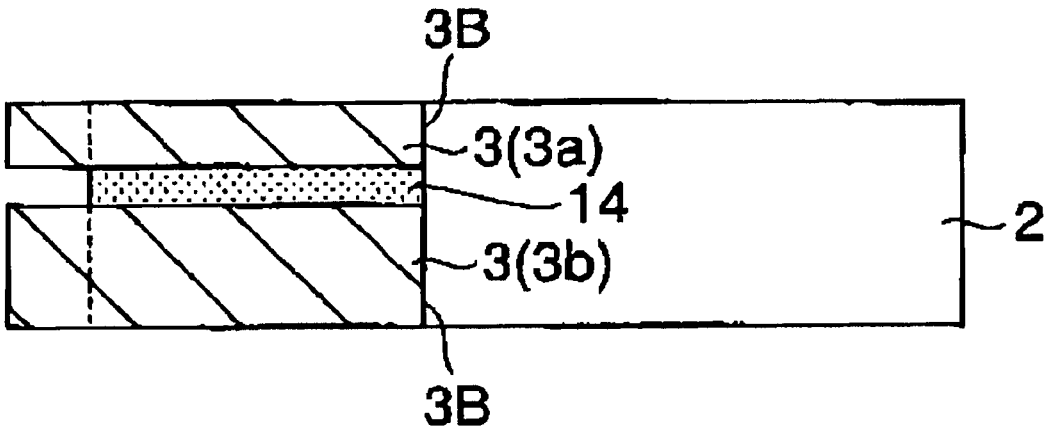
FIG. 14 shows an example of a configuration in which a dielectric is provided between adjoining radiation electrode branches.

Further, as shown in FIG. 14, when a plurality of radiation electrode branches 3 (3*a* and 3*b*) are provided, a dielectric 14 may be provided between the radiation electrode branches 3 (3*a* and 3*b*). For example, when one of the two adjoining radiation electrode branches 3 defines a feeding radiation electrode and the other radiation electrode branch 3 defines a passive radiation electrode so as to generate a multi-resonance state, the level of the electromagnetic coupling between the radiation electrode branches 3 (3*a* and 3*b*) must be adjusted in order to realize a favorable multi-resonance state. In this case, by providing the dielectric 14 between the radiation electrode branches 3 (3*a* and 3*b*) and adequately adjusting the permittivity of the dielectric 14, the electromagnetic coupling between the radiation electrode branches 3 (3*a* and 3*b*) can be easily adjusted. Accordingly, a favorable multi-resonance state can be realized, so that the antenna gain can be increased and the bandwidth can be broadened.

Next, a third preferred embodiment will be described. In the third preferred embodiment, elements which are the same as those in the first and second preferred embodiments are denoted by the same reference numerals, and the corresponding description will be omitted.

Figure 15A:
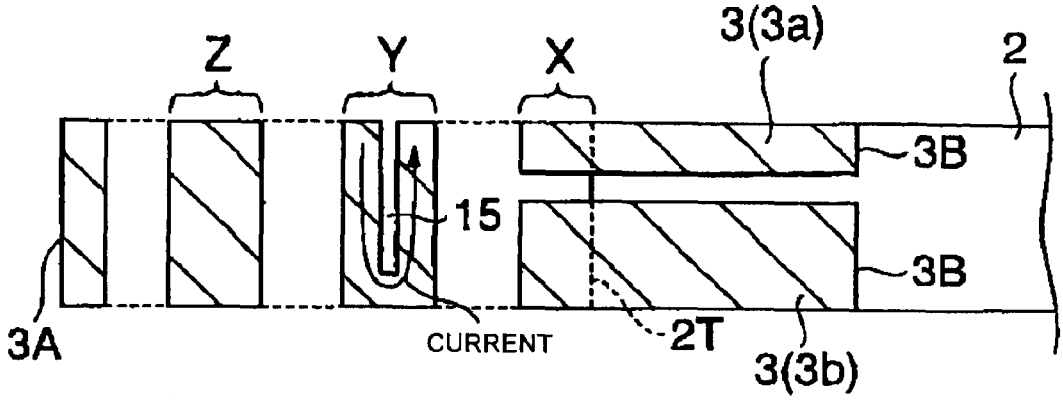
FIGS. 15A to 15C illustrate the configuration of a third preferred embodiment of the present invention.
Figure 15B:
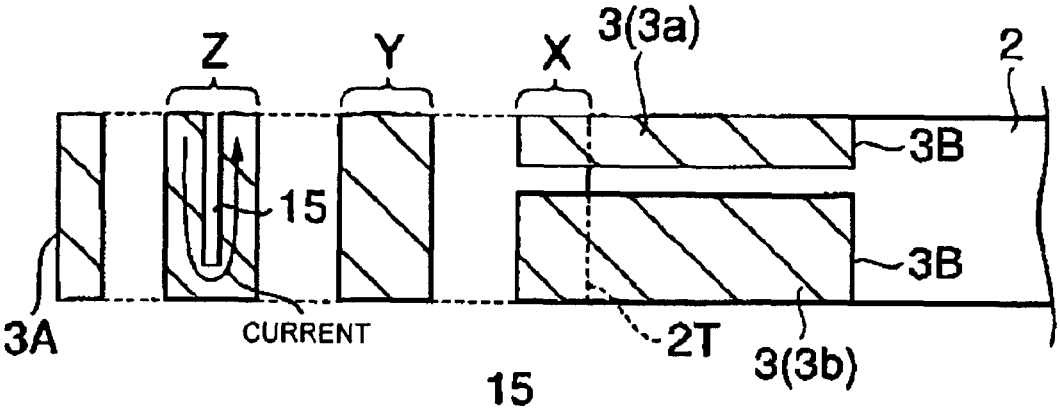

In the third preferred embodiment, in addition to the configuration of the first and second preferred embodiments, a slit 15 is provided in the radiation electrode 3, the slit 15 extending in the direction that is substantially perpendicular to the direction in which the radiation electrode 3 extends from the connected end 3A to the open end 3B, as shown in developed views in FIGS. 15A and 15B.

By forming the slit 15, a current flowing through the radiation electrode 3 detours around the slit 15, and thus the electric length of the radiation electrode 3 can be increased. In the third preferred embodiment, the slit 15 is provided in a portion in which a magnetic field strength is maximized in the radiation electrode 3 (a portion Z in the back side of the board 2, as shown in FIG. 15B), or a portion at the vicinity thereof (for example, a portion Y which faces the edge 2T of the board 2, as shown in FIG. 15A). By providing the slit 15 in a portion in which a magnetic field strength is maximized in the radiation electrode 3 or at the vicinity thereof, the effect of increased electric length of the radiation electrode 3 can be further improved. Accordingly, a compact and thin radiation electrode 3 having the set resonance frequency can be easily obtained.

Figure 15C:
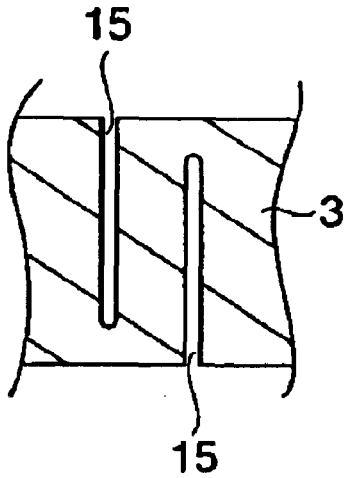

The number of slit 15 is not limited to one, but a plurality of slits 15 may be provided as shown in FIG. 15C.

Next, a fourth preferred embodiment will be described. In the fourth preferred embodiment, elements which are the same as those in the first to third preferred embodiments are denoted by the same reference numerals, and the corresponding description will be omitted.

Figure 16:
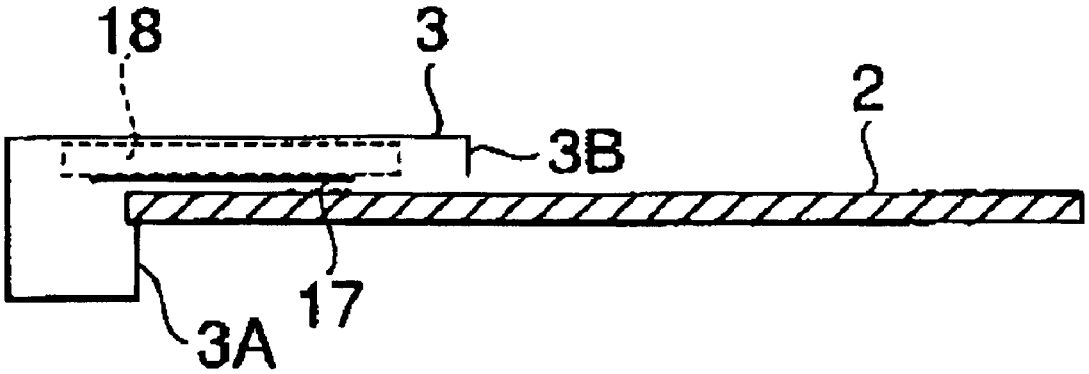
FIG. 16 illustrates the configuration of a fourth preferred embodiment of the present invention.
Figure 17A:
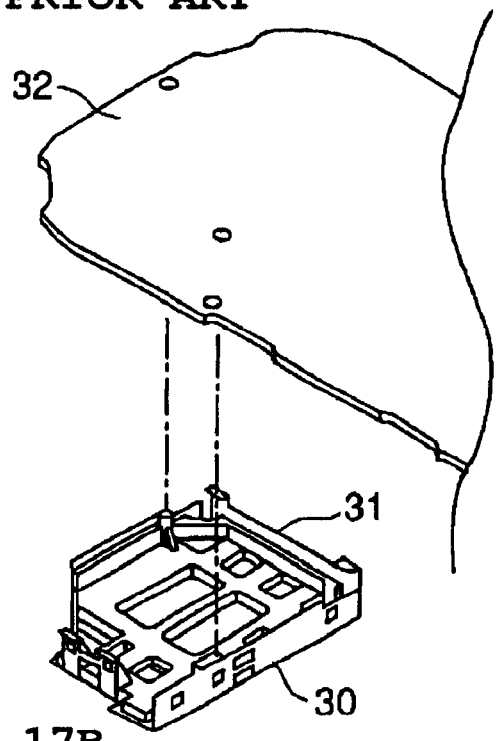
FIG.17A PRIOR ART
FIGS. 17A and 17B illustrate one of the configurations disclosed in the reference 1.
Figure 17B:
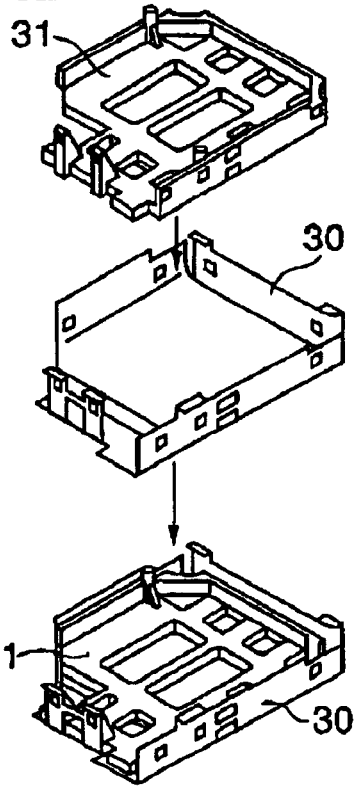
FIG.17B PRIOR ART
Figure 18:
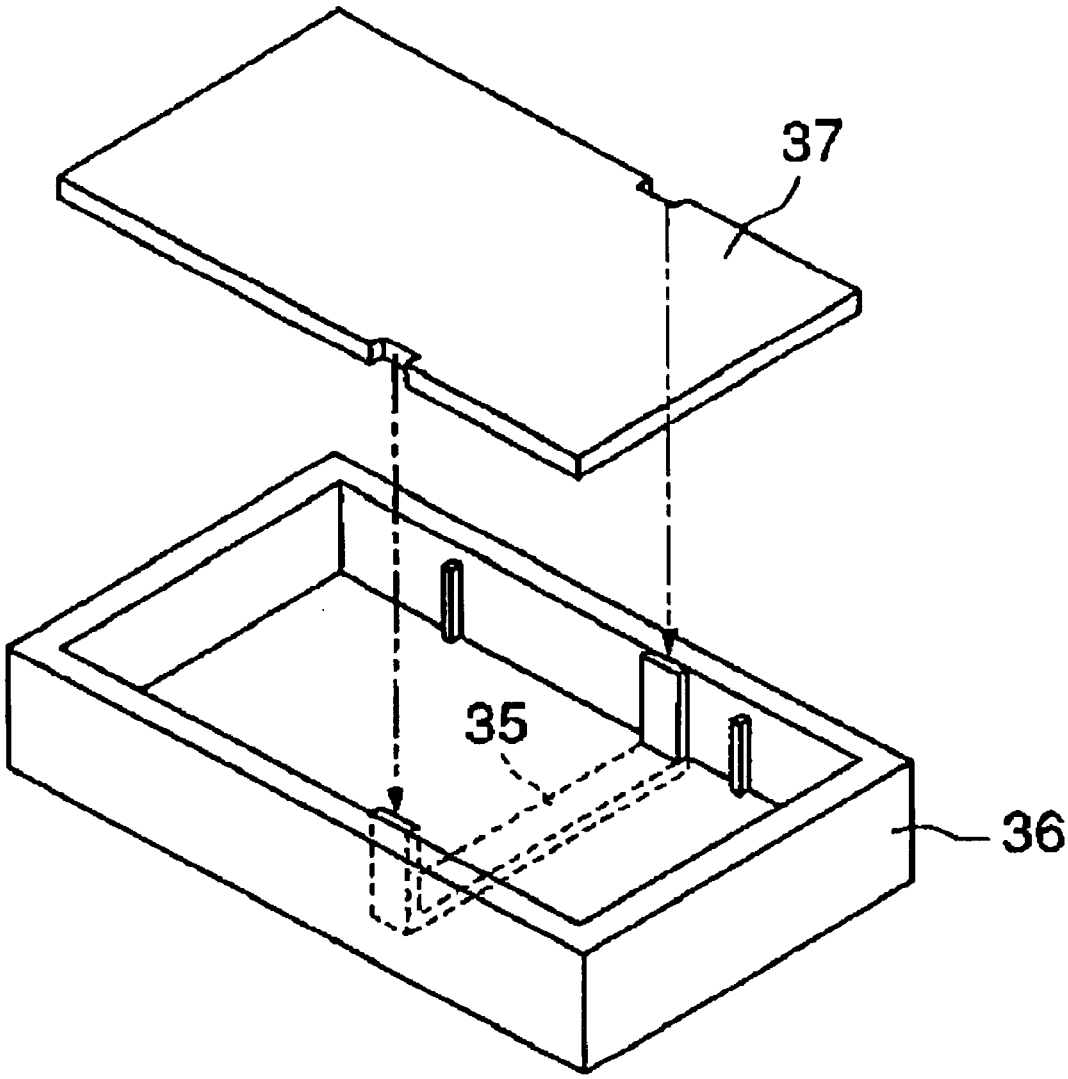
FIG. 18 PRIOR ART
FIG. 18 illustrates one of the configurations disclosed in the reference 2.
Figure 19:
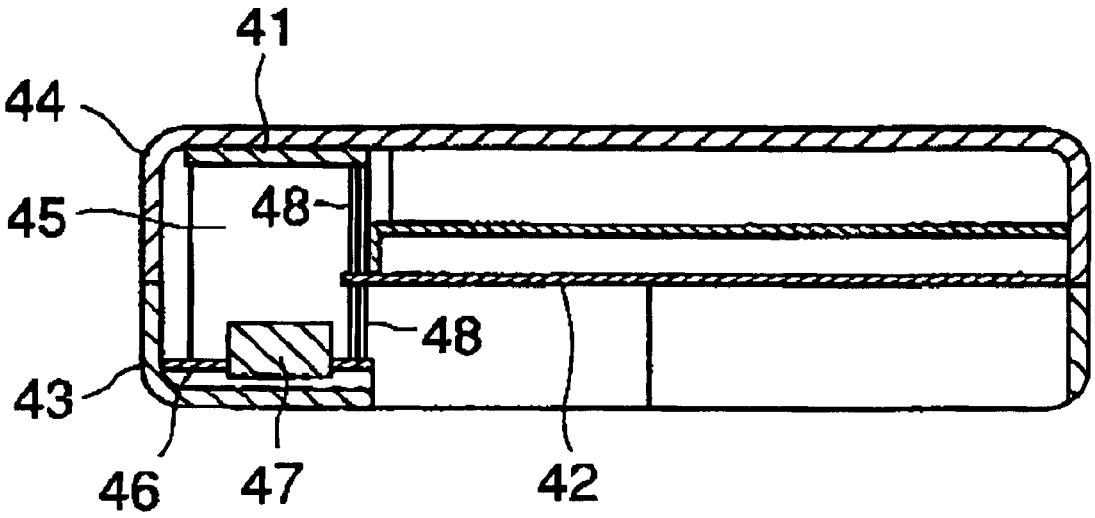
FIG. 19 PRIOR ART
FIG. 19 illustrates one of the configurations disclosed in the reference 3.

In the fourth preferred embodiment, a radiation electrode 17 is provided in a space defined by the radiation electrode 3 and the board 2, as shown in a side view in FIG. 16. The other configuration is almost the same as in the first to third preferred embodiments.

The radiation electrode 17 may be $\lambda/4$-type or $\lambda/2$-type. Herein, the configuration of the radiation electrode 17 is not limited.

In the fourth preferred embodiment, a space between the thin radiation electrode 3 and the radiation electrode 17 is very small, and thus the radiation electrodes 3 and 17 are coupled with each other, so that they are subject to be affected by each other. In this case, the coupling between the radiation electrodes 3 and 17 is preferably adjusted so that the radiation electrodes 3 and 17 resonate favorably. In order to adjust the coupling between the radiation electrodes 3 and 17, a dielectric 18 may be provided between the radiation electrodes 3 and 17, as indicated with a broken line in FIG. 16.

Next, a fifth preferred embodiment will be described. The fifth preferred embodiment relates to a communication apparatus, which is a portable phone. A feature of the fifth preferred embodiment is that any one of the antennas 1 of the first to fourth preferred embodiments of the present invention is incorporated into the communication apparatus. In the fifth preferred embodiment, the antenna 1 is not described since it has been described above. The other elements of the communication apparatus than the antenna 1 may be configured in any way, and the description thereof will be omitted.

The present invention is not limited to the first to fifth preferred embodiments, and other various preferred embodiments can be realized. For example, in FIG. 14, two radiation electrode branches 3*a* and 3*b* are provided and the dielectric 14 is provided between the radiation electrode branches 3*a* and 3*b*. Alternatively, when three or more radiation electrode branches 3 are formed, dielectrics may be provided between respective adjoining radiation electrode branches, or a dielectric may be provided between only selected radiation electrode branches.

In the fourth preferred embodiment, the radiation electrode 17 is provided in the space between the board 2 and the radiation electrode 3. The radiation electrode 17 may be formed on the front surface of the board 2 or inside the board 2. In this way, when the radiation electrode 17 is provided on the front surface of the board 2 or inside the board 2, the radiation electrode 17 and the board 2 may be integrally formed by using a molding technique.

Further, in the fifth preferred embodiment, the antenna 1 is incorporated into a portable phone. Alternatively, the antenna of various preferred embodiments of the present invention may be provided in any communication apparatus other than the portable phone.

According to various preferred embodiments of the present invention, one end of the radiation electrode is connected to the conductive portion on the front surface or back surface of the board. The radiation electrode extends outward from the conductive portion starting from the connected end, is bent around the edge of the board so as to form a loop-shaped configuration, and extends to the side opposite to the side of the starting point. The other end of the radiation electrode is positioned above the surface of the board with a space therebetween, so as to define an open end.

The radiation electrode extends from one side to the other side of the board. Therefore, the electric length of the radiation electrode is longer compared to the case where the radiation electrode is formed in only one side of the board. Accordingly, the radiation electrode (antenna structure) can be miniaturized and the thickness of the antenna can be decreased by reducing the distance from the surface of the board and the radiation electrode, while allowing the radiation electrode to have the set resonance frequency.

Also, an electric volume, which has an effect on the bandwidth and gain of the radiation electrode, is increased by extending the radiation electrode from one side to the other side of the board. Accordingly, the gain can be increased and the bandwidth can be broadened.

Further, since the radiation electrode extends from one side to the other side of the board, the distance between the maximum magnetic field region and the maximum electric field region can be increased. Also, since the distance between the maximum electric field region and the human's head can be increased, deterioration of the performance can be practically prevented, and thus an antenna having a favorable characteristic can be realized.

The antenna of various preferred embodiments of the present invention can realize the above-described favorable effects by using any of a direct connecting method, in which the radiation electrode is directly connected to the signal conduction unit defining a feeding electrode, and a capacitive connecting method, in which the radiation electrode is connected to the signal conduction unit (for example, feeding electrode) via capacitance. When the signal conduction unit is connected to the radiation electrode via capacitance, a matching circuit for matching the signal conduction unit side and the radiation electrode side can be omitted. Further, when the direct connecting method is adopted, the portion of the radiation electrode which is directly connected to the signal conduction unit is not limited. Accordingly, by connecting the signal conduction unit and the radiation electrode so that the impedance in the signal conduction unit side is substantially equal to the impedance in the radiation electrode side at the connecting portion of the signal conduction unit and the radiation electrode, the matching circuit can be omitted and thus the circuit structure can be simplified.

Also, when a plurality of radiation electrode branches are provided, by generating a multi-resonance state by using the plurality of radiation electrode branches, the gain can be further increased and the bandwidth can be further broadened. Furthermore, when the plurality of radiation electrode branches have different resonance frequency bands, the antenna structure for performing communication in a plurality of frequency bands can be obtained. In this way, by providing the plurality of radiation electrode branches, an antenna structure for easily satisfying various needs can be obtained.

When a dielectric is provided between at least a pair of adjoining radiation electrode branches, the electromagnetic coupling between the adjoining radiation electrode branches can be easily adjusted, and each of the radiation electrode branches can obtain a favorable resonance state. Accordingly, reliability of communication is greatly improved.

By providing a slit in the radiation electrode, the electric length of the radiation electrode can be increased without increasing the effective length of the radiation electrode. Accordingly, the size and thickness of the antenna can be further reduced.

Also, when a dielectric is provided between at least the open end of the radiation electrode and the board, the electric length of the radiation electrode can be increased. Accordingly, the size and thickness of the antenna can be further reduced.

When different radiation electrode branches are superposed with a space therebetween, an antenna which is compliant with a plurality of frequency bands can be provided in a reduced space. Further, by providing a dielectric between the radiation electrode branches, the coupling relationship between the radiation electrode branches can be easily adjusted, and thus the antenna structure can be easily designed.

By using the compact and thin antenna of various preferred embodiments of the present invention, the size and thickness of a communication apparatus can be easily reduced. Also, in the communication apparatus of preferred embodiments of the present invention, communication reliability is greatly improved by a broader bandwidth, increased gain, and an effect of suppressing deterioration of the antenna characteristic, the deterioration being caused by approach of an object.

Further, by providing a component of the communication apparatus in a space defined by the radiation electrode, a wasted space can be reduced and the communication apparatus can be miniaturized.

While the present invention has been described through illustration of preferred embodiments with reference to the accompanying drawings, various modifications and changes can be made without departing from the spirit of the invention.

What is claimed is:

1. An antenna structure comprising:

a board on which electronic components are mounted;

a conductive portion disposed on at least one of a front surface and a back surface of the board; and a radiation electrode for performing an antenna operation; wherein one end of the radiation electrode is connected to the conductive portion, the radiation electrode extends outward from the conductive portion starting from the connected end, is bent around an edge of the board so as to form a loop-shaped configuration, and extends to a side opposite to the side of a starting point thereof such that a space is provided between the radiation electrode and the board, and the other end of the radiation electrode is positioned such that a space is provided between the other end and the conductive portion of the board with a capacitance therebetween, so that the other end functions as an open end.

2. The antenna structure according to claim 1, further comprising a feeding electrode, which is a branch of the radiation electrode.

3. The antenna structure according to claim 1, further comprising a feeding electrode, which is positioned with a space between the feeding electrode and the open end of the radiation electrode and which is coupled with the open end by capacitive coupling.

4. The antenna structure according to claim 1, wherein the radiation electrode includes a plurality of radiation electrode branches, which have a common base portion connected to the board, and the radiation electrode branches are arranged to have a space therebetween.

5. The antenna structure according to claim 4, wherein a dielectric member is provided between at least a pair of said adjoining radiation electrode branches.

6. The antenna structure according to claim 1, wherein a slit is formed in the radiation electrode, the slit extending in a direction that is substantially perpendicular to the direction in which the radiation electrode extends from said one end to the other end.

7. The antenna structure according to claim 1, wherein a dielectric member is provided between at least the open end of the radiation electrode and a surface of the board.

8. The antenna structure according to claim 1, wherein another radiation electrode is provided on the surface of the board or inside the board integrally.

9. The antenna structure according to claim 8, wherein a dielectric member is provided between the radiation electrode and said another radiation electrode.

10. The antenna structure according to claim 3, wherein the feeding electrode is located on a surface of the board or inside the board.

11. The antenna structure according to claim 1, wherein the radiation electrode is one of a $\lambda/4$-type radiation electrode and a $\lambda/2$-type radiation electrode.

12. The antenna structure according to claim 1, wherein the conductive portion includes a portion of the radiation electrode.

13. The antenna structure according to claim 1, wherein the conductive portion includes a coaxial line.

14. The antenna structure according to claim 1, wherein the conductive portion includes a spring pin which is fixed to the board.

15. The antenna structure according to claim 1, wherein the radiation electrode is directly connected to the conductive portion which defines a feeding electrode.

16. The antenna structure according to claim 1, wherein the radiation electrode is connected to the conductive portion via capacitance.

17. The antenna structure according to claim 1, wherein the radiation electrode extends from one side to the other side of the board.

18. A communication apparatus comprising the antenna structure according to claim 1, wherein a component is provided in a space defined by the radiation electrode.

19. The communication apparatus according to claim 18, wherein the communication apparatus is a portable phone.

* * * * *